United States Patent [19]

Fortmann

[11] 4,277,164

[45] Jul. 7, 1981

[54] PHOTOCOPIER PHOTOCONDUCTIVE SHEET HOLDING DEVICE

[75] Inventor: Hermann Fortmann, Bremen, Fed. Rep. of Germany

[73] Assignee: Olympia Werke AG, Wilhelmshaven, Fed. Rep. of Germany

[21] Appl. No.: 57,995

[22] Filed: Jul. 16, 1979

[30] Foreign Application Priority Data

Jul. 14, 1978 [DE] Fed. Rep. of Germany ..... 2830955

[51] Int. Cl.[3] ..... G03G 15/00

[52] U.S. Cl. ..... 355/16; 101/415.1; 355/3 DR

[58] Field of Search ..... 355/3 DR, 16, 3 R; 101/DIG 13, 408–412, 415.1

[56] References Cited

U.S. PATENT DOCUMENTS

| | | | |
|---|---|---|---|
| 3,276,365 | 10/1966 | Langer | 101/415.1 |
| 3,600,086 | 8/1971 | Cates et al. | 355/16 |
| 3,719,142 | 3/1973 | Abe | 101/415.1 X |
| 3,750,573 | 8/1973 | Haeusler et al. | 355/16 X |
| 3,839,961 | 10/1974 | Murata | 355/3 DR |
| 3,858,513 | 1/1975 | Murata | 101/415.1 |
| 3,883,242 | 5/1975 | Takahashi et al. | 355/3 R |
| 3,896,727 | 7/1975 | Ruckdeschel | 101/415.1 |
| 3,903,795 | 9/1975 | Suzuki | 101/409 |
| 4,179,211 | 12/1979 | Kimura et al. | 355/16 X |
| 4,183,652 | 1/1980 | Yanagawa | 355/16 X |
| 4,219,272 | 8/1980 | Brückel | 355/3 DR |

FOREIGN PATENT DOCUMENTS

| | | | |
|---|---|---|---|
| 2337296 | 2/1974 | Fed. Rep. of Germany | 101/409 |
| 2406162 | 4/1976 | Fed. Rep. of Germany | 355/3 R |
| 2707694 | 1/1977 | Fed. Rep. of Germany | 355/3 DR |

OTHER PUBLICATIONS

*IBM Tech. Disc. Bull.,* "Drum Seal Interlock" vol. 20, No. 10, Mar. 1978, pp. 3837, 3838.

*Primary Examiner*—William H. Beha, Jr.
*Attorney, Agent, or Firm*—Spencer & Kaye

[57] ABSTRACT

In an electrophotographic copier including a replaceable photoconductive sheet having a leading edge portion and a trailing edge portion and a guide drum rotatably supported by a drum shaft and having a circumferential surface for supporting the sheet and a holding device for securing the leading sheet edge portion to the guide drum, the holding device is composed of elements defining a wedge-shaped slot disposed alongside the circumferential surface of the drum and delimited by a pair of faces which converge toward the circumferential surface where they form an insertion opening for a photoconductive sheet, a wedge loosely disposed in the wedge-shaped slot, and an element urging the wedge toward the insertion opening for clamping a photoconductive sheet end inserted in the slot between the wedge and one of the faces.

4 Claims, 3 Drawing Figures

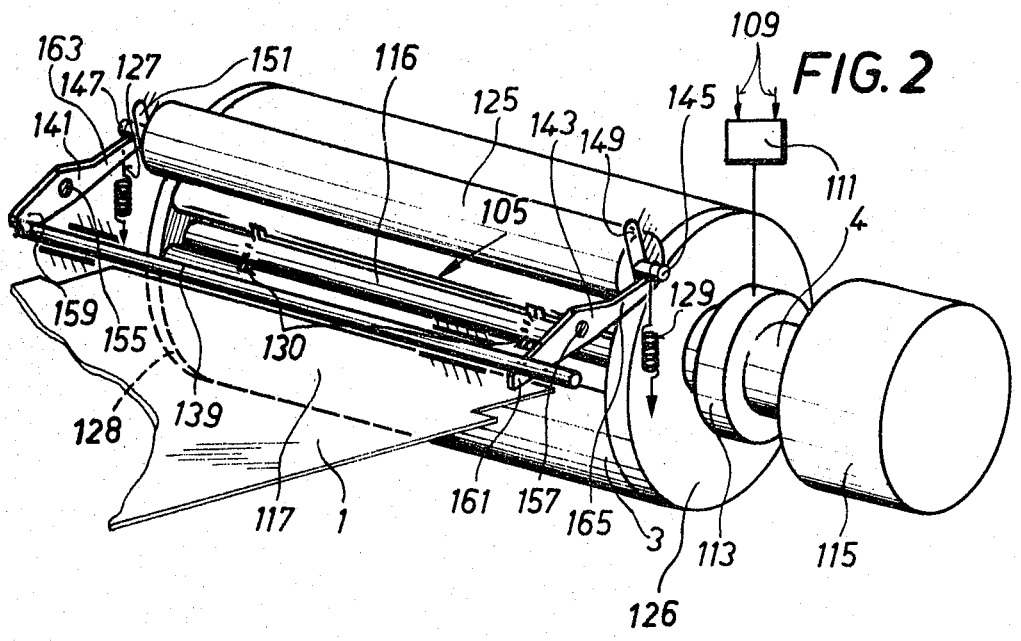
FIG. 2
FIG. 3
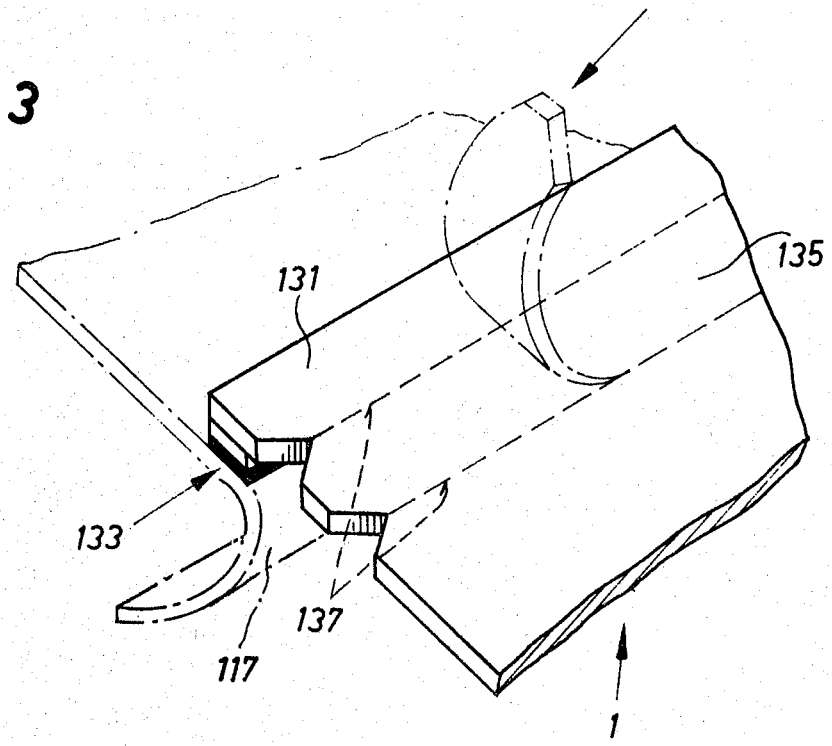

PHOTOCOPIER PHOTOCONDUCTIVE SHEET HOLDING DEVICE

BACKGROUND OF THE INVENTION

This invention relates to an electrophotographic copying apparatus (hereafter "photocopier") having a replaceable photoconductive sheet of finite length. The leading edge of the sheet is secured to a guide drum by means of a holding device. About the guide drum there are arranged, in close vicinity to one another, a charging station, an illuminating station, a developing station, a transfer station and a cleaning station where, respectively and in sequence, the photoconductive sheet is charged and photographically exposed to light, the image is developed by a magnetic toner, the image on the photoconductive sheet is transferred to a record medium and the photoconductive sheet is cleaned.

A large proportion of known and widely used photocopiers have a recording drum which carries on its cylindrical surface a layer of recording material, for example, a photoconductive layer. The drum rotates in a housing which also accommodates the various processing stations. Since, because of a deficiency inherent in the principle of photocopying processes, a complete transfer of the toner—which is applied for rendering visible the latent charge image—to the record medium (copy) is not feasible, the residual toner has to be removed from the drum by mechanical means, for example, with the aid of a brush. If such a toner-removing operation is not performed, a toner film builds up on the photoconductive layer, making necessary a frequent cleaning or premature replacemnt of the recording drum to ensure that the copy quality does not fall below a predetermined standard. It is another disadvantage of photoconductive layers provided firmly on the recording drum that a replacement of the entire drum is necessary as soon as the upper surface thereof is damaged.

A cleaning, an examination for damaged areas and a replacement of the recording drum can be performed only by qualified personnel; this circumstance increases the cost of an otherwise low-price copy obtained by an electrophotographic coyping process.

The above-discussed disadvantages are eliminated in known copiers by providing a photoconductive sheet maintained taut about the drum. Such an arrangement is disclosed, for example, in U.S. Pat. No. 3,600,086. The photoconductive sheet extends from a supply roll positioned inside the copier drum to the outside thereof, extends about the drum circumference, then enters the drum and is wound on a take-up roll. This arrangement provides for an automatic replacement of the photoconductive layer at the end of its useful life. This mechanically complex system is expensive and is used only in high-output automatic copiers which otherwise would have to be continuously attended by maintenance personnel.

Further, U.S. Pat. No. 3,883,242 discloses an electrophotographic copier which has a replaceable photoconductive sheet positioned on a drum-shaped guide component and provided at both ends with holder plates. After positioning the sheet about the cylindrical outer face of the drum, bore holes provided in the holer plates at one end of the sheet are brought into alignment with holder pins carried by the drum, while a spring at the other end of the image plate is hooked into a spring-supporting post also carried by the drum. Although in this manner, to be sure, the photoconductive sheet can be mounted securely on the drum, its involved replacement requires a certain skill and adroitness on behalf of the operating personnel.

Further, German Auslegeschrift (Published Accepted Patent Application) No. 2,406,162 discloses an electrophotographic copier including a photoconductive sheet glued together at its ends to constitute an endless band. This known arrangement, however, does not operate to cause the trailing end of the photoconductive sheet to be automatically connected with the leading end thereof.

SUMMARY OF THE INVENTION

It is an object of the invention to provide an improved electrophotographic copier which has a replaceable photoconductive sheet of finite length carried by a guide drum, wherein a replacement of the sheet can be effected rapidly, securely and without particular skill.

It is an advantage of the invention that it provides for a simple and rapid replacement of the photoconductive sheet without requiring particular adroitness by the maintenance personnel. The leading edge of such a photoconductive sheet can subsequently be released simply by pressing the resiliently mounted wedge back away from the insertion opening with the aid of a handy instrument, such as a ball-point pen, scissors or other simple means.

According to an advantageous embodiment of the invention, the wedge, which can be a circular rod, can be provided with radially projecting, conductive prongs capable of penetrating a nonconductive coating on the photoconductive sheet in order to establish contact with the conductive layer thereof and thereby ground the sheet.

BRIEF DESCRIPTION OF THE DRAWINGS

FIG. 2 is a detail, perspective view of a portion of the structure shown in FIG. 1.

FIG. 3 is a detail, perspective view showing the leading and trailing edges of a photoconductive sheet which is provided with an adhesive layer.

DESCRIPTION OF THE PREFERRED EMBODIMENTS

Figure 1:
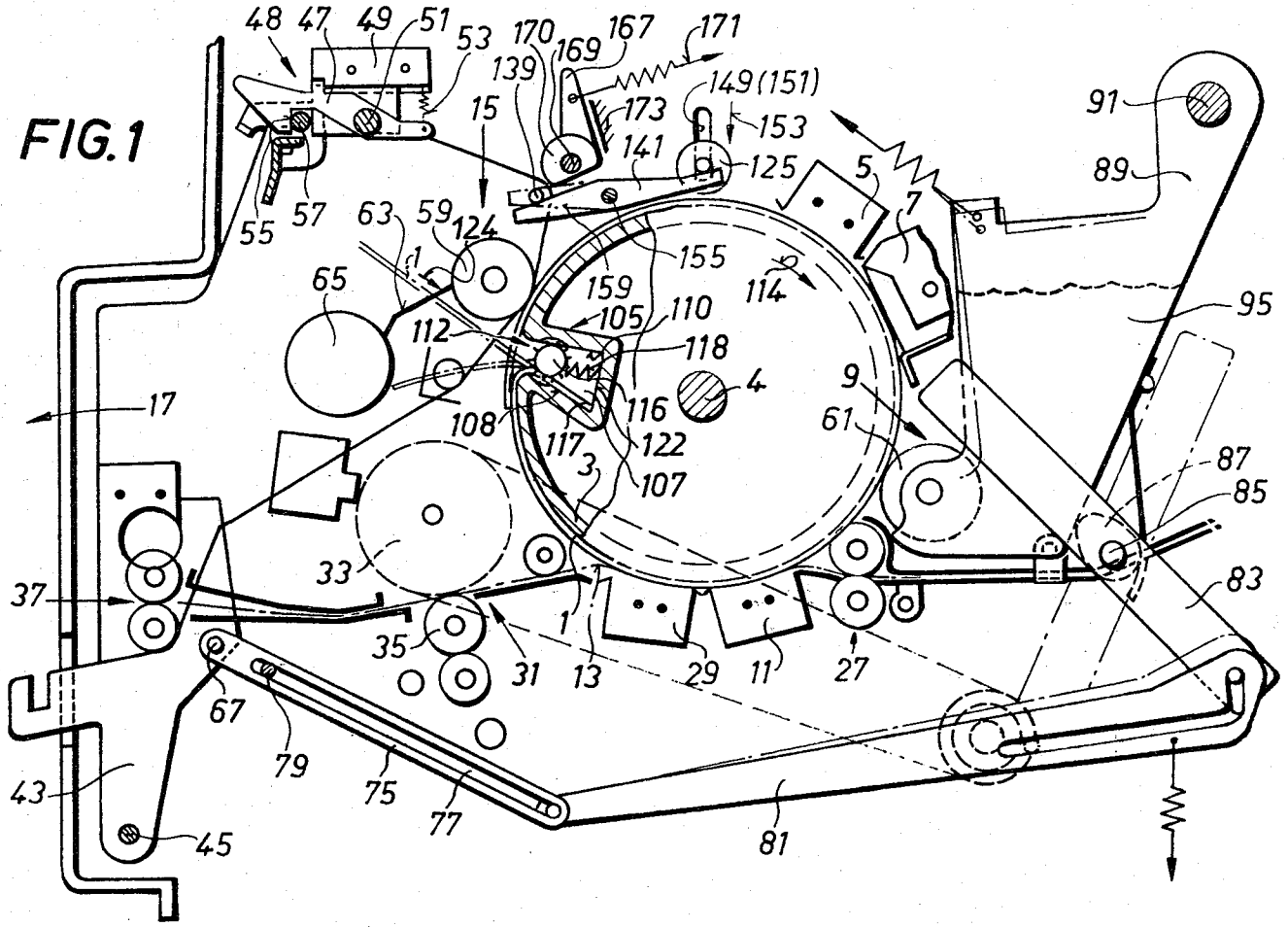
FIG. 1 is a simplified, cross-sectional view of the interior of an electrophotographic copier illustrating a preferred embodiment of the invention and the components cooperating therewith.

Turning now to FIG. 1, the electrophotographic copier shown therein includes a photoconductive sheet 1 firmly secured to a guide drum 3 which is rotatably supported in the copier frame (not shown) and which, by virtue of its rotation, moves past the individual processing stations arranged about the circumference of the drum.

Thus, first, the photoconductive sheet 1 is electrostatically charged in a charging station 5, then it is photographically exposed in station 7 and thereafter it is moved into the developing station 9 for development. Subsequently, the image on the photoconductive sheet 1 is transferred in a transfer station 11 onto a record medium 13. The toner particles which remain on the photoconductive sheet 1 subsequent to the transfer are removed from the sheet 1 in a cleaning station 15. The above-outlined processing stations are shown only schematically, are all well known and may be of various designs.

The record medium 13 is constituted by a length of paper drawn from a supply roll and advanced between feed roller pairs to a cutting device where sheets of predetermined length are cut. None of these components are shown since they are conventional in the art. The severed sheets are thereafter brought into contact with the photoconductive sheet 1 on the guide drum 3 by means of additional feed roller pairs, the downstream pair 27 being shown. The image developed on the photoconductive sheet 1 is transferred to the record medium 13 by a transfer head of the transfer station 11 and thereafter the record medium 13 is separated from the photoconductive sheet 1 by a separator head 29 and is advanced to a pressure-fixing station 31. The latter is formed of two pressure rolls 33 and 35 which are spring-biased against one another. Subsequent to the pressure fixing of the toner image onto the record medium 13, the latter is discharged from the copier by a feed roller pair 37.

After a photoconductive sheet 1 has been used up, after the production of, for example, 600 copies, it has to be replaced. For this purpose, first a front cover forming part of the copier housing is removed. Thereafter, the cleaning station 15 which is supported in a first rocker 43 is, after unlatching an associated locking device 48, swung counterclockwise from its illustrated position in the direction of arrow 17. The lock 48 has at least one latch lever 47 which is rotatably supported on a shaft 51 held in a bearing bracket 49. The latch lever 47 which can be shifted and immobilized in the copier frame, is biased in the counter-clockwise direction by a tension spring 53 and hooks with a locking face 55 behind a detent pin 57 mounted on the rocker 43. It is feasible to provide corresponding locking devices on both sides of the rocker 43. The first rocker 43 is pivotally supported on a shaft 45 which extends parallel to the shaft 4 of the guide drum 3.

The cleaning station 15 has, for cleaning the photoconductive sheet 1 subsequent to a transfer of a toner image from the photoconductive sheet onto the record medium 13, a magnetic brush 59 which is formed of the same magnetic single component as a magnetic developing brush 61 of the developing station 9. Thus, the magnetic cleaning brush 59 removes the residual toner particles from the photoconductive sheet 1 subsequent to the transfer process. By means of a stripper 63 which cooperates with the magnetic cleaning brush 59, the toner particles are advanced into a container 65.

To the first rocker 43 there is articulated, at a pivot 67, a connecting lever 75 which has a guide slot 77 into which projects a support pin 79 fixed to the copier frame. By virtue of this arrangement the connecting lever 75 is shiftably and rotatably supported. The connecting lever 75 is further articulated to a link 81 which, in turn, is connected with a pivotal lever 83. A shaft 85, fixedly attached to the pivotal lever 83, is rotatably supported in the copier frame and carries two eccentric members 87 (only one shown in FIG. 1).

A second rocker 89 is pivotally mounted on a support shaft 91 and is swingable thereabout under control of the eccentric members 87. The second rocker 89 rotatably supports the magnetic developing brush 61 and includes a toner receptacle 95.

As will be described later, the first rocker 43 and the second rocker 89 are connected to one another by means of the linkage assembly 83, 81 and 75 in such a manner that for replenishing the toner receptacle 95 with new toner, only the second rocker 89 is pivoted away from the guide drum 3, whereas for replacing the photoconductive sheet 1, both rockers 43 and 89 are pivoted away from the guide drum 3.

Upon removal of the previously mentioned front cover of the housing, access is gained to two switching members (not shown) which are connected, as shown in FIG. 2, with a control member 111 by means of conductors 109. The control member 111 controls a clutch 113 for force-transmittingly coupling a drive 115 to the guide drum 3. By a manual actuation of one of the switching members, the guide drum 3 is rotated in the direction of the arrow 114 of FIG. 1 through the intermediary of the control member 111 and the clutch 113, while an actuation of the other switching member causes the guide drum 3 to turn in the other direction of rotation. Thus, with the aid of the two switching members, the operator can rapidly bring a holding device, which is arranged at the circumference of the guide drum 3 and which serves for positioning the photoconductive sheet 1 on the guide drum 3, into a forward position in which it is rendered accessible by pivoting the first rocker 43 into its unlocked, open position, in the direction of arrow 17 of FIG. 1.

As the rocker 43 is pivoted away from the position shown in FIG. 1 in the direction of arrow 17, two-arm pivotal levers 141 and 143, shown in FIGS. 1 and 2, supported on the copier frame via respective pins 155 and 157, are released by a rod 139 which is fixedly supported on the rocker 43. The pivotal levers 141 and 143 are in force-transmitting connection with respective axial support pins 145 and 147 of a pressing roll 125. The support pins 145 and 147 are slidably received in respective guide slots 149 and 151 provided in the copier frame and are biased by respective springs 127 and 129 in the direction of the arrow 153 of FIG. 1.

In order to enable the pressing roll 125 to be lifted away from the guide drum 3 even in the open position of the rocker 43, on the copier frame there are provided two manually engageable levers 167 (only one being shown in FIG. 1) which are pivotal about a shaft 169 and are each provided with an eccentric member 170. The eccentric members 170, when the levers 167 are manually urged counterclockwise against the force of the respective springs 171, exert a force on the arms 159, 161 of the levers 141, 143 to thus cause lifting up of the pressing roll 125. In their rest position, the hand-operated levers 167 are maintained against respective stops 173 fixed to the copier frame by means of the respective springs 171.

In order to prevent a soiling of the pressing roll 125, the latter is provided, for example, by means of spraying, with a coating made of an antistatic material such as Netic, product of Shield Division, Perfection Mica Co., USA.

The pressing roll may be made of a nonmagnetic material such as brass. In this manner, the magnetic toner particles are prevented from being attracted by the photoconductive sheet 1 which would cause soiling of the pressing roll 125.

One embodiment of a holding device according to the invention is shown at 105 in FIGS. 1 and 2. This device is in the form of a clamping and aligning block defining a wedge-shaped slot 107 arranged along the surface of the guide drum 3. The wedge faces 108 and 110 of the wedge-shaped slot 107, which taper toward the drum surface, form an insertion opening 112 for the photoconductive sheet 1. The rear of slot 107 is delimited by an abutment surface 122 and the lateral sides of the slot are bounded by circular flanges 126 and 128 of the drum shown in FIG. 2. An electrically conductive wedge 116 of circular cross section is loosely disposed in this wedge slot 107 and is pressable toward the insertion opening 112 by means of compression springs 118 spaced along the length of slot 107. The wedge may also be an elongate body having an asymmetrical cross section.

When the leading edge 117 of the photoconductive sheet 1 is inserted into the insertion opening 112 in the direction of the arrow 124 of FIG. 1, the circular rod 116 is pushed back against the force of springs 118 so that the leading edge 117 comes to rest against the abutment surface 122 at the rear of the wedge-shaped slot 107. If then the sheet 1 is pulled in the direction opposite that of arrow 124, the circular rod 116 is pulled toward opening 112 by the friction force between it and sheet 1 such that the leading edge 117 of the photoconductor 1 is clamped in the slot. Then the guide drum 3 is caused to rotate in the direction of the arrow 114 of FIG. 1.

When the rocker 43 has been pivoted into the out-of-engagement position of the magnetic cleaning brush 59, i.e. in the direction of arrow 17, a pressure roller 125 is automatically pressed by springs 127 and 129, shown in FIG. 2, against the circumference of drum 3. Thus the sheet 1 whose leading edge 117 has already been fastened during movement of guide drum 3 in the direction of arrow 114 is pressed against the circumference of the guide drum 3 so that roller 125 automatically presses, as shown in FIG. 3, the trailing edge 131 carrying an adhesive layer 133 against the leading edge 117 so that layer 133 connects the edges together. Removal of a spent photoconductive sheet is effected, as shown in FIG. 3, via a tear-off strip 135 extending over the entire width of the sheet 1. This strip is connected in the closed loop via perforations 137.

The trailing edge 131 of the photoconductive sheet 1 may of course also be connected with the guide drum 3 by electrostatic means or by way of some other connection.

Of importance is the simple and secure fastening, according to the invention, of the leading edge 117 of sheet 1 to the guide drum 3 in a manner which requires no particular dexterity on the part of the operator. When the photoconductive sheet 1 has been inserted into the wedge-shaped slot 107 until it abuts at the abutment surface 122 and is fitted between circular flanges 126 and 128 arranged to both sides of the guide drum 3, the sheet becomes automatically aligned in such a manner that it is no longer possible to place it on the guide drum in any other but a straight orientation. The circular flanges 126 and 128 simultaneously serve to fix the circular rod 116 against axial movement in the wedge-shaped slot 107.

Release of the leading edge 117 of the photoconductive sheet 1 from the guide drum 3 is effected by simply pressing the spring-biased wedge back into the wedge-shaped slot 107. This can be done with the aid of a ball-point pen or some other simple means available in an office.

In order to also be able to use photoconductive sheets 1 having a nonconductive surface without requiring further work on them, the circular rod 116 is provided with one or more sets of conductive prongs 130, two sets being shown in FIG. 2, which can be pressed through such nonconductive layer into the conductive layer of the photoconductive sheet for fastening the sheet to the guide drum 3 by means of the clamping block. This produces a ground connection in the simplest way.

The diameter of wedge 116 must be a little smaller than the width of slot opening 112 whereby the wedge 116 has to be inserted in the wedge-shaped slot 107 from one side of the guide drum 3.

It will be understood that the above description of the present invention is susceptible to various modifications, changes and adaptations and the same are intended to be comprehended within the meaning and range of equivalents of the appended claims.

What is claimed is:

1. In an electrophotographic copier including a replaceable photoconductive sheet having a leading edge portion and a trailing edge portion which sheet is composed of a conductive layer and a nonconductive coating on the layer; a guide drum rotatably supported by a drum shaft and having a circumferential surface for supporting the sheet and a holding device for securing the leading sheet edge portion to the guide drum; a charging station, an illuminating station, a developing station, a transfer station and a conductive sheet cleaning station arranged in a circumferential distribution about the guide drum, the improvement wherein said holding device comprises: means defining a wedge-shaped slot disposed alongside the circumferential surface of said drum and delimited by a pair of faces which converge toward the circumferential surface where they form an insertion opening for a photoconductive sheet; a wedge in the form of an electrically conductive circular rod loosely disposed in said wedge-shaped slot, said circular rod being provided with radially projecting conductive prongs capable of penetrating the nonconductive coating of the sheet in order to contact the conductive layer when the photoconductive sheet is fastened to said guide drum by means of said holding device so as to ground the photoconductive sheet; and means urging said wedge toward said insertion opening for clamping a photoconductive sheet leading edge portion inserted in said slot between said wedge and one of said faces.

2. Device as defined in claim 1 wherein said guide drum comprises circular flanges disposed at axial ends of said drum, delimiting the ends of said slot, constraining said wedge against movement parallel to the axis of said drum.

3. Device as defined in claim 1 wherein said wedge-shaped slot is further delimited by a rear face extending between said pair of faces at a location remote from said insertion opening and defining an abutment for the leading edge portion of a sheet inserted in said slot.

4. Device as defined in claim 3 wherein said guide drum comprises circular flanges disposed at axial ends of said drum, delimiting the ends of said slot, constraining said wedge against movement parallel to the axis of said drum.

* * * * *